United States Patent [19]

White et al.

[11] 4,293,011

[45] Oct. 6, 1981

[54] RAFTER CUTTING MACHINE

[75] Inventors: Thomas M. White, Hartland, Vt.; Edwin A. Barton, East Hampton, Conn.; Jesse P. Ware, Kittery Point, Me.

[73] Assignee: Vermont Log Buildings, Inc., Hartland, Vt.

[21] Appl. No.: 40,686

[22] Filed: May 21, 1979

[51] Int. Cl.[3] ..... B27C 9/04; B27M 3/00

[52] U.S. Cl. ..... 144/3 R; 83/409; 83/433; 83/435.1; 198/339; 198/486; 269/56; 269/61; 269/238; 144/133 R; 144/242 R; 144/246 R; 144/326 R

[58] Field of Search ..... 83/409, 415, 433, 435.1, 83/435.2, 425.2, 862, 865; 414/14, 16, 751, 753; 198/339, 486; 144/2 R, 3 R, 39, 133 R, 242 R, 246 R, 326 R; 269/56, 61, 13, 238

[56] References Cited

U.S. PATENT DOCUMENTS

| | | | |
|---|---|---|---|
| 3,735,787 | 5/1973 | Siel | 83/425.2 |
| 3,865,255 | 2/1975 | Krause | 414/753 |
| 4,022,094 | 5/1977 | Hetherington | 83/409 |
| 4,040,459 | 8/1977 | Bush, Jr. et al. | 83/425.2 |
| 4,098,310 | 7/1978 | Sanford et al. | 144/3 R |

*Primary Examiner*—W. D. Bray

*Attorney, Agent, or Firm*—Charles E. Pfund

[57] ABSTRACT

Apparatus for cutting and notching beams to predetermined specification comprising spaced parallel loading and discharge stations for receiving and discharging beams to be treated, transfer jaws operable to seize a beam at the receiving station and move it therefrom to the discharge station in a direction at right angles to its length, operating instrumentalities for performing one or more cutting operations on the beams at different places longitudinally thereof, trolleys supporting the operating instrumentalities intermediate the loading and discharge station at a level above the path of travel of the beams from the loading station to the discharge station such that the transfer jaws move the beams into engagement with all of the operating instrumentalities as they move the beams from the loading station to the discharge station and drive means for effecting reciprocation of the transfer jaws and operating instrumentalities.

18 Claims, 14 Drawing Figures

RAFTER CUTTING MACHINE

BACKGROUND OF THE INVENTION

Customarily, roof beams (rafters) are precut so as to be ready for setting up at the site upon which a building is to be constructed by cutting the ends of the beams at one end—the upper ends at angles corresponding to the angle at the ridge pole and by cutting notches near the other ends—the lower ends at angles to sit on the wall plates at the tops of the side walls. Additionally, the lower ends of the rafters may also be cut at angles corresponding to the angles at the upper ends. The end cuts are generally made individually with the aid of circular saws and the notches are made with a cylindrical cutter while the beam is manually held in place which can be dangerous. It is the purpose of this invention to provide apparatus for automatically making all of these cuts simultaneously.

SUMMARY OF THE INVENTION

As herein illustrated, the apparatus comprises spaced parallel loading and discharge stations for receiving and discharging beams to be precut, transfer means operable to seize a beam at the receiving station and move it therefrom to the discharge station in a direction at right angles to its length, operating instrumentalities for performing one or more operations on the beams at different places longitudinally thereof, means supporting the operating instrumentalities intermediate the loading and discharge stations at a level above the path of travel of the beams from the loading station to the discharge station such that the transfer means moves the beams into engagement with all of the operating instrumentalities as it moves the beams from the loading station and discharge station and means for effecting reciprocation of the transfer means and operation of the operating instrumentalities. The loading and discharge stations comprise spaced parallel conveyor means for moving a beam longitudinally thereon to a predetermined position with respect to the cutting instrumentalities and each comprises a frame mounting longitudinally-spaced, parallel rollers supported for rotation about horizontal axis transverse to the longitudinal dimension of the supporting frames. The rollers on the discharge conveyor are preferably power driven to automatically discharge the finished beams. The transfer means comprise longitudinally-spaced jaws and means for opening and closing the jaws on a beam at each station to, respectively, seize a beam at the loading station and release it at the discharge station. The transfer means are mounted on carriages movable longitudinally of the conveyors and each jaw comprises a lower stationary jaw member situated at a level to be moved beneath a beam resting on the conveyor at the loading station and an upper jaw arranged to be moved from a position retracted from the lower jaw to a position of clamping engagement with the top of the beam resting on the conveyor at the loading station. The transfer carriages are supported adjacent the discharge station and each is provided with rack and pick pinion means for moving the jaws transversely from one station to the other. The means supporting the operating instrumentalities are trolleys supported for movement lengthwise of the conveyors on tracks supported on spaced parallel relation above the conveyors and intermediate the same. The trolleys are mounted in suspension from the tracks, and there is means for fixing the trolleys at a predetermined position thereon and means supporting the operating instrumentalities for adjustment height-wise with respect to the path of movement of the beam therebelow and for angular adjustment about a horizontal axis. For end cuts, the operating instrumentalities comprise circular saws and for notches the instrumentalities comprise cylindrical cutters.

The invention will now be described in greater detail with reference to the accompanying drawings wherein.

Figure 1:
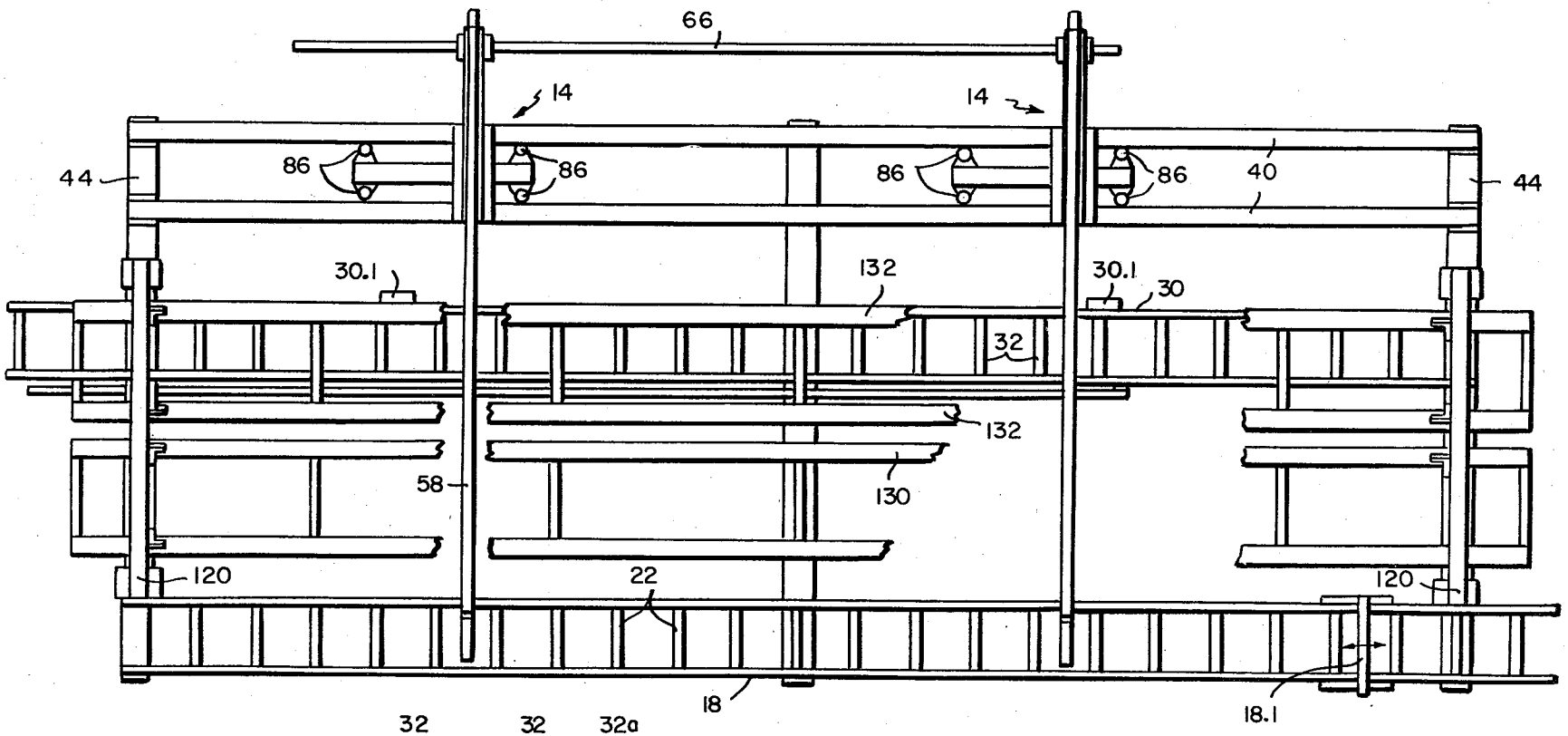
FIG. 1 is a plan view of the apparatus with portions broken away.
Figure 2:
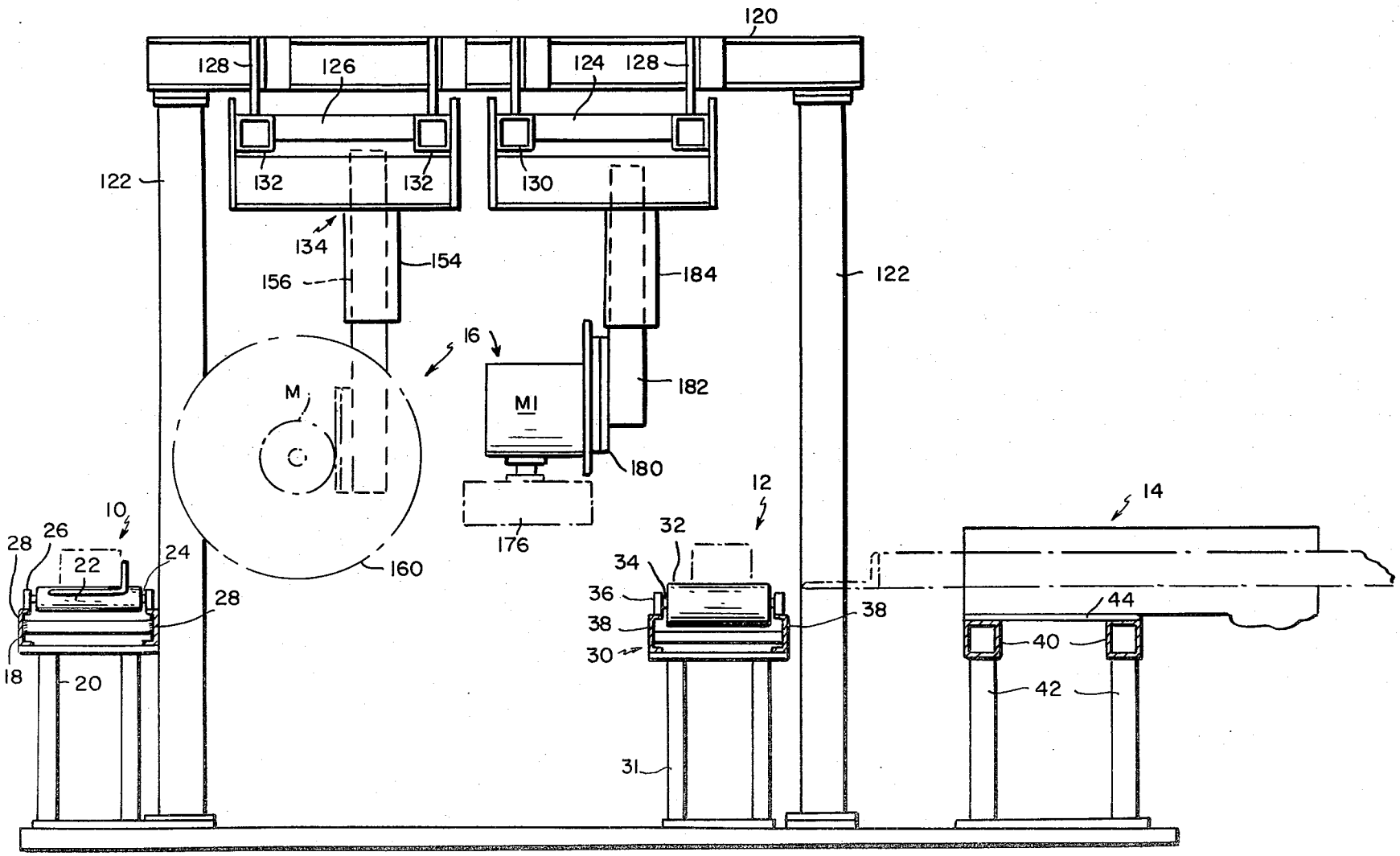
FIG. 2 is an elevation as seen from the right end of FIG. 1.

Referring to the drawings, FIGS. 1 and 2, the apparatus comprises essentially a loading station 10, a discharge station 12, a transfer means 14 for moving a beam from the loading station to the transfer station and operating instrumentalities 16 supported above the plane of travel of the beam from the loading station to the discharge station for performing one or more cutting operations on the beam.

At the loading station 10, there is an elongate conveyor frame 18 supported at its intervals lengthwise thereof by vertically-disposed legs 20 and supporting transversely of its length longitudinally-spaced parallel rollers 22. The rollers 22 are rotatably supported by trunions 24 rotatably received within bearing blocks 26 mounted on the conveyor frame 18, the latter, as illustrated, being comprised of spaced parallel channel beams 28—28. As mounted, the axis of rotation of the rollers 22 are situated above the plane of the upper sides of the channel beams 28—28.

Figure 12:
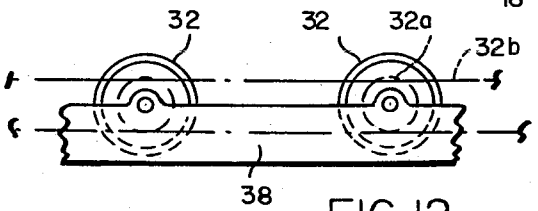
FIG. 12 is a fragmentary elevation showing chain and sprocket means for driving the rollers on the discharge conveyor.

The station 12 is similarly an elongate conveyor frame 30 supported by vertically-disposed legs 31 and supporting transversely-disposed, longitudinally-spaced parallel rollers 32. The rollers 32 are rotatably supported on the frame by trunions 34 rotatably received in bearing blocks 36 mounted on the conveyor frame 30 and the latter is comprised of spaced parallel channel beams 38—38. The axis of rotation of the rollers 32 are above the plane of the upper edges of the channel beams 38. The rollers 32 are rubber covered and power driven to discharge the finished beam by chain and sprocket means **32*a*, 32*b*, FIG. 12**. The conveyors at the two stations are parallel.

Figure 8:
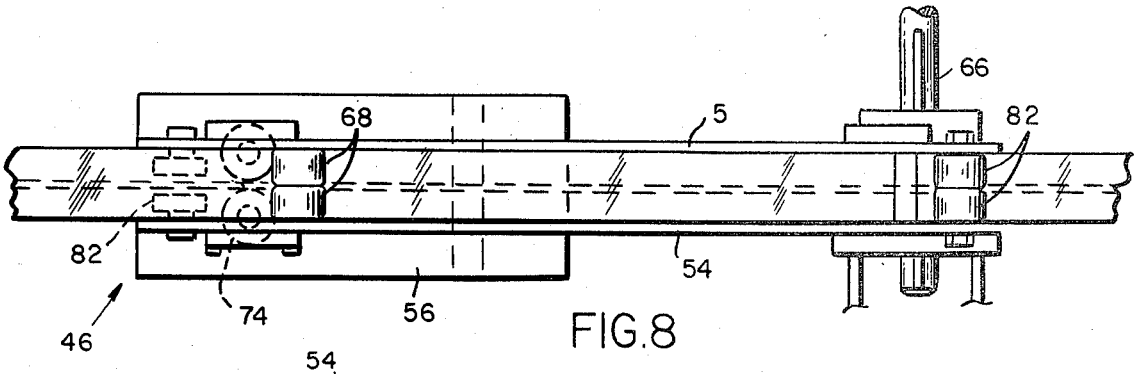
FIG. 8 is a plan view of FIG. 7.
Figure 7:
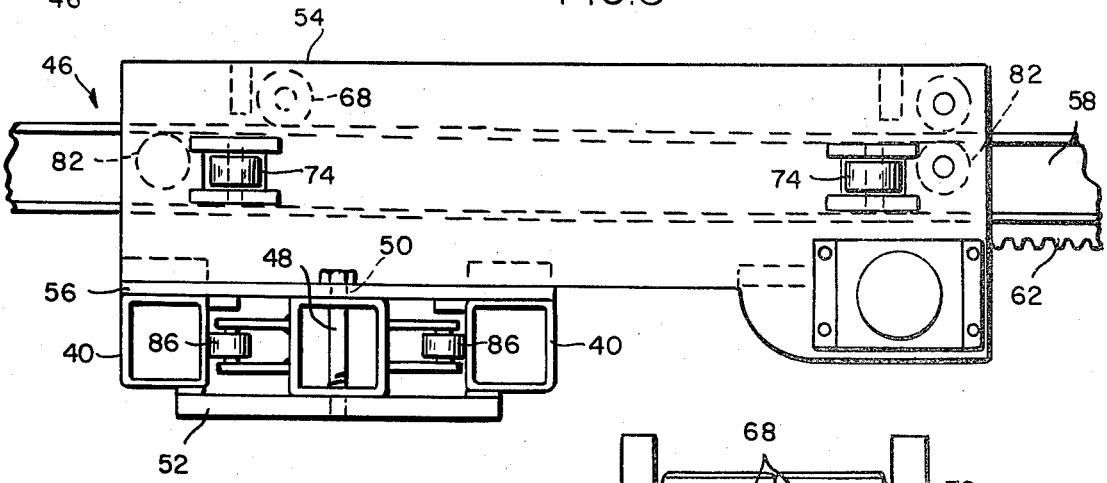
FIG. 7 is an elevation of one of the transfer carriages.
Figure 9:
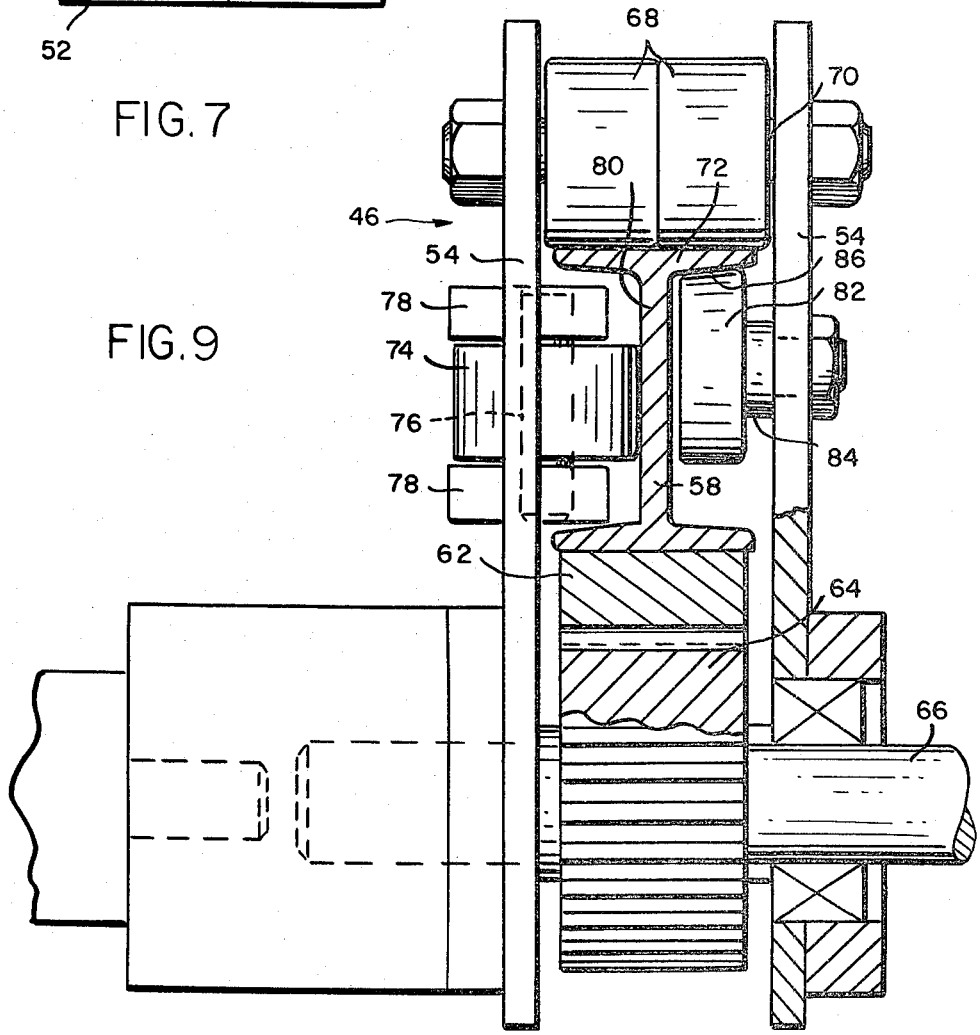
FIG. 9 is an enlarged elevation taken from the right side of FIG. 8.
Figure 11:
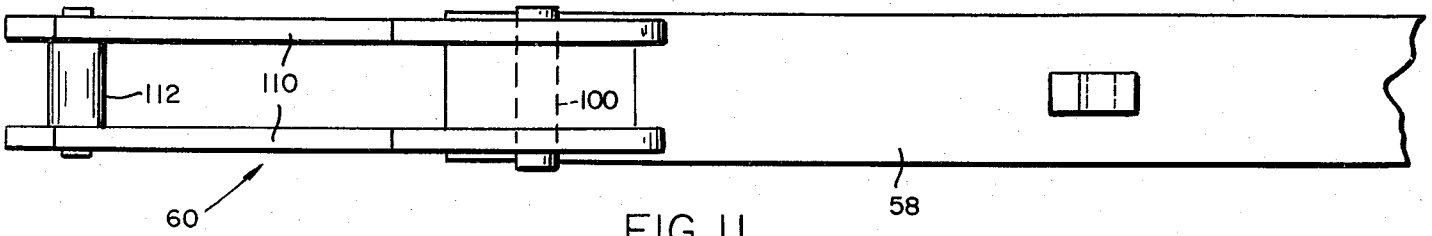
FIG. 11 is a plan view of FIG. 10.
Figure 10:
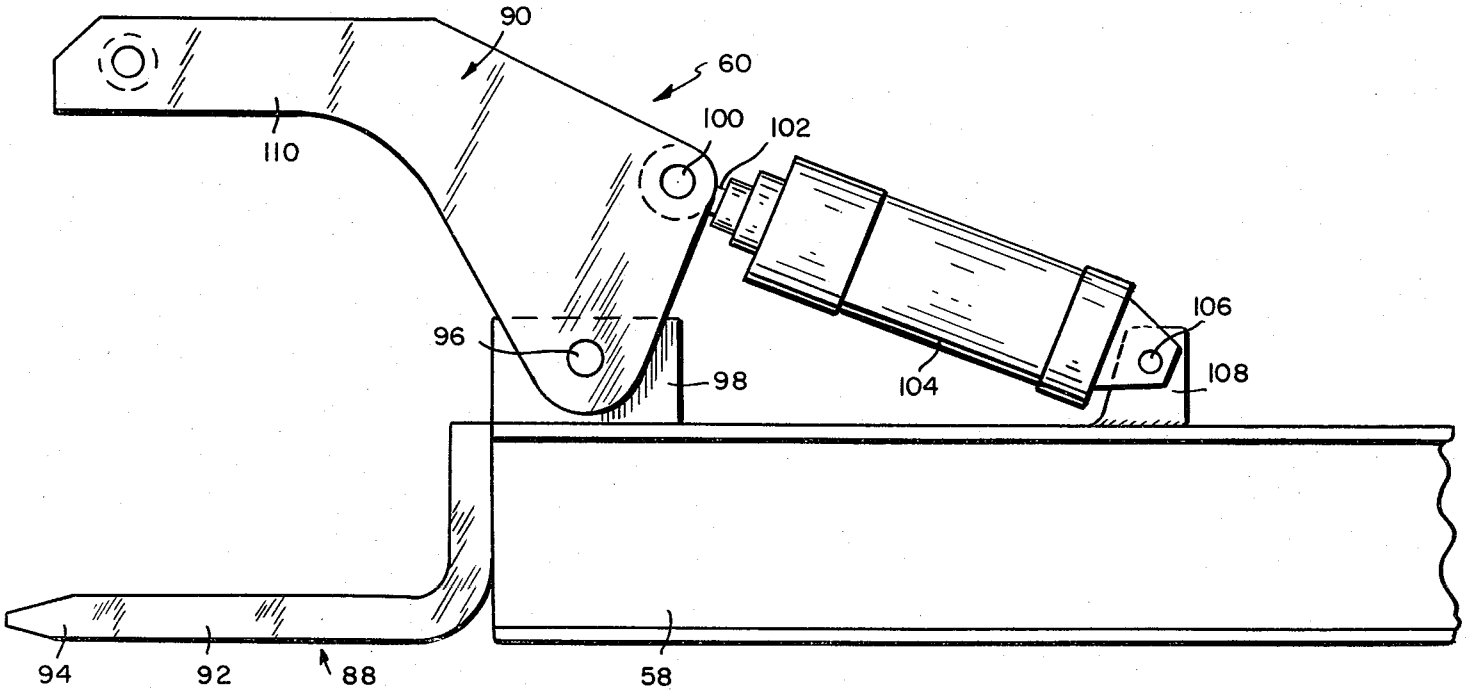
FIG. 10 is an enlarged elevation of a clamping jaw.

The transfer means 14 is situated laterally of the discharge conveyor and parallel thereto on a supporting frame comprising longitudinally-extending, spaced, parallel beams 40 supported by vertically-disposed legs 42 and connected at longitudinally-spaced intervals by cross plates 44. Referring to FIGS. 7, 8 and 9, the transfer means 14 comprises two carriages 46 mounted in a horizontal position of the beams 40—40 and rigidly clamped thereto by bolts 48 inserted through holes 50 in the carriage and screwed into plates 52 at the undersides of the beams 40—40. Each carriage 46 as shown in FIG. 9 comprises spaced, parallel plates 54—54 welded or otherwise fastened to a bottom plate 56 to form a channel for receiving an I-beam 58 for movement in the channel transversely with respect to the loading and discharge conveyors for moving a clamping jaw 60 such as shown in FIGS. 10 and 11 transversely between the loading and discharge stations to seize a log resting on the conveyor at the loading station and move it transversely to the discharge station. The I-beam 58 which supports the jaw is supported between the plates 54—54 for reciprocal movement by pairs of rollers 68 mounted between the plates 54—54 on shafts 70 with their surfaces in tangential engagement with the upper flange 72 of the I-beam; pairs of rollers 74 rotatably mounted on shaft 76 between supports 78—78 with their peripheral surface in tangential engagement with opposite sides of the web 80 of the I-beam; and pairs of rollers 82 rotatably supported on stub shafts 84 fixed to the side plate 54, tangentially engaged with the underside 86 of the upper flange of the I-beam which, for this purpose, are slightly conical. As thus supported, the I-beam is rigidly guided horizontally with respect to the loading and discharge conveyors and its reciprocal movement is effected by means of a rack bar 62 fixed to its lower flange and a pinion gear 64 in mesh therewith fixed to a shaft 66. As previously stated, there are two such carriages and by unscrewing the clamp bolts 48, the spacing of these carriages longitudinally of the conveyors may be increased or decreased for beams of different length. To facilitate such longitudinal adjustment and to guide them, there are provided rollers 86—86 which bear against the inner sides of the beams 40—40.

The I-beams have at their distal ends jaws 60 as shown in FIGS. 10 and 11 and each jaw comprises a lower fixed jaw member 88 and an upper pivoted jaw member 90. The fixed jaw member 88 is welded or otherwise fixed to the I-beam 58 in such a position that the upper surface of its fork 92 is parallel to and just below the top surfaces of the rollers 22 so that when the jaw is moved to a position to clamp onto a beam resting on the loading conveyor, the fork 92 will move underneath the beam. Desirably, the forward end of the fork is tapered at 94 to permit it to move smoothly into place between the lower side of the beam even though there may be some irregularities in the beam itself. The upper jaw member 90 is pivotally supported at 96 on a block 98 welded or otherwise fastened to the I-beam 58 and is pivotally connected at 100 to a piston rod 102 extending from an air cylinder 104, the latter being pivotally connected at 106 to a block 108 welded or otherwise fastened to the I-beam 58. The jaw member 90 is mounted high enough above the jaw member 88 so that, when retracted, there is sufficient space between them to receive beams of the dimensions which are to be processed. As shown in FIG. 11, the lower jaw member 88 comprises a single fork whereas the upper jaw member comprises spaced, parallel jaw plates 110—110 rigidly joined to each other by a cross pin 112.

As thus far described, the two conveyors provide for receiving a beam for cutting and thereafter discharging the finished beam.

The transfer jaw seize a beam on the loading conveyor, and moving it onto the discharge conveyor where it is discharged. The beams are hand-loaded onto the loading conveyor, but are automatically discharged from the discharge conveyor by the rubber covered rollers which as previously related are power driven. There is a longitudinally adjustable stop 18.1 on the loading conveyor to position the beam correctly with respect to the cutting instrumentalities and stops 30.1 on the discharge conveyor to allow the jaws to be withdrawn without dislodging the beam from the conveyor rollers.

Figure 4:
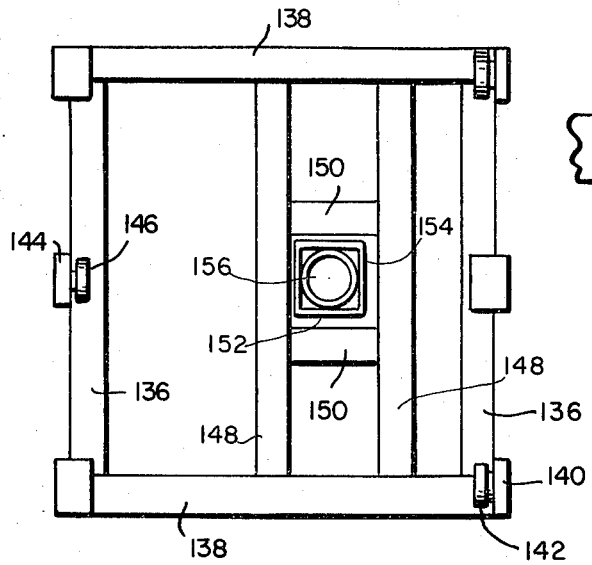
FIG. 4 is a plan view of FIG. 3.
Figure 5:
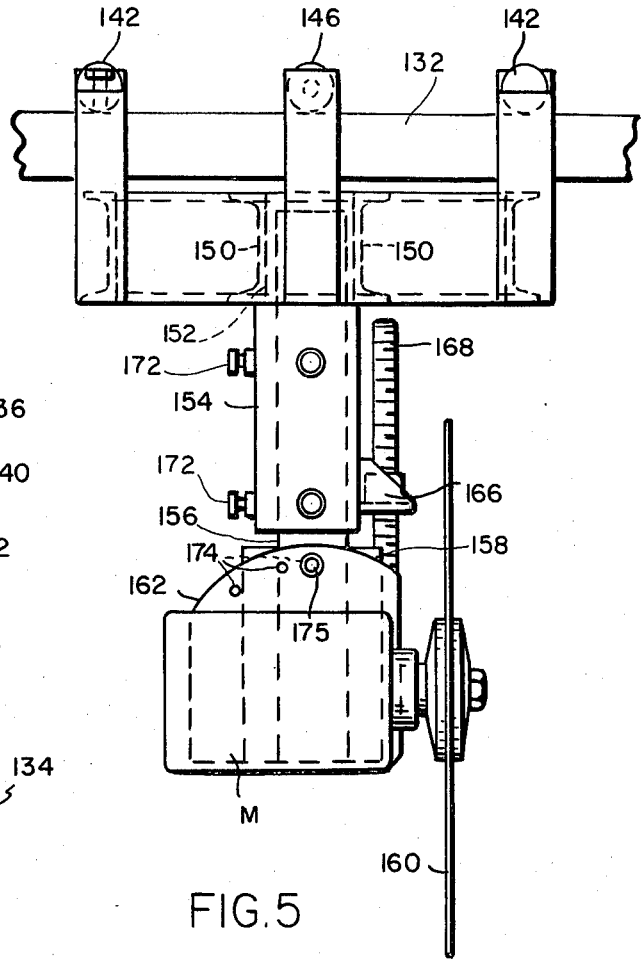
FIG. 5 is an elevation taken at right angles to FIG. 3 showing the circular saw.
Figure 3:
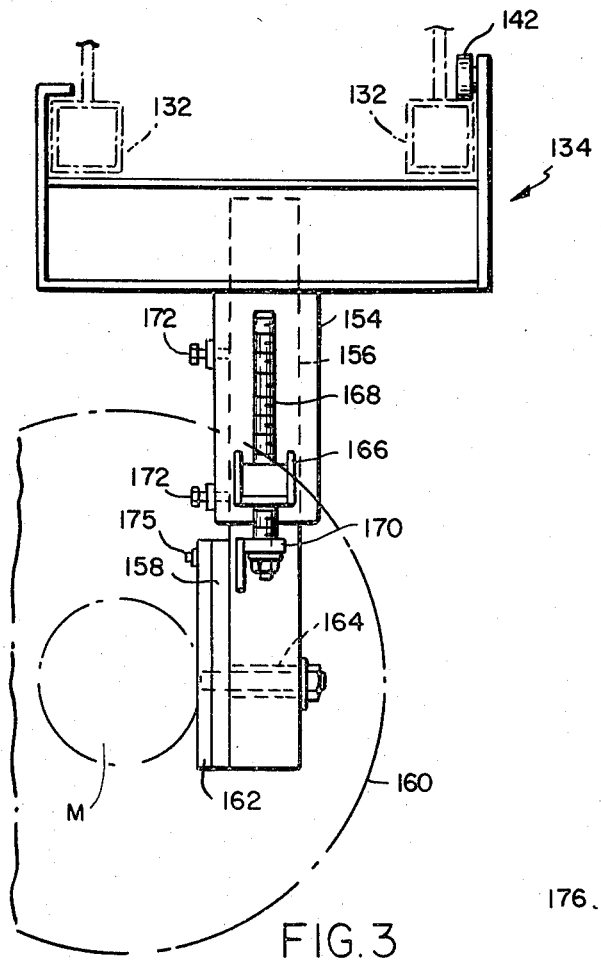
FIG. 3 is an elevation of a trolley for supporting a circular saw.

For performing the several operations on a beam as it is moved from the loading conveyor to the discharge conveyor, there are provided, as previously mentioned, operating instrumentalities 16 and these are supported above the loading and discharge conveyor upon a superstructure comprising horizontally-disposed supporting beams 120 which rest at their opposite ends on vertically-disposed posts 122. Spaced, parallel, longitudinally-extending tracks 124, 126 are suspended from the beams 120 by means of hanger plates 128. The tracks comprise spaced, parallel, longitudinally-extending beams 130 and 132. Mounted on the tracks 130, 132 there are trolleys, each comprising, as shown in FIG. 4, a rigid, rectangular structure having spaced, parallel side members 136—136 and spaced, parallel end members 138—138. At two of the corners, there are hangers 140—140, the lower ends of which are fixed to the side member 136 at that side and to the upper end of which are rotatably mounted rollers 142. At the opposite side, there is a hanger 144, the lower end of which is attached to the side 136 at that side and to the upper end of which is rotatably mounted a roller 146. These rollers, as shown in FIGS. 3 and 5, support the frame on the tracks 132 for movement longitudinally of the superstructure. Each trolley is provided with spaced, parallel, longitudinal and transverse structural elements 148 and 150 which define an opening 152. A sleeve 154 is welded to the trolley frame in alignment with the opening 152 and a post 156 is mounted in the sleeve for vertical adjustment therein. A flat plate 158 is fixed to the lower end of the post for one of the operating instrumentalities which, in this case, is a circular saw 160. To enable adjusting the plane of operation of the saw, a mounting plate 162 is pivotally mounted on the plate 158 for angular adjustment about the axis of a bolt 164 and the motor M which drives the saw is bolted to the mounting plate 162. To enable adjusting the height of the saw, a bracket member 166 is fixed to the sleeve 154 and a screw-threaded spindle 168 is threaded through the bracket and is rotatably connected at its lower end to a second bracket 170 fastened to the lower end of the post. By rotating the screw, the post may be raised or lowered in the sleeve 154. Screws 172—172 are provided to fix the plate at a predetermined position of adjustment. The mounting plate 162 is rotatable about the axis of the bolt 164 and is provided with arcuately-arranged, spaced holes 174 for receiving pins 175 for engagement with correspondingly positioned holes in the plate 158 to fix the saw in a selected position of angular adjustment.

Figure 6:
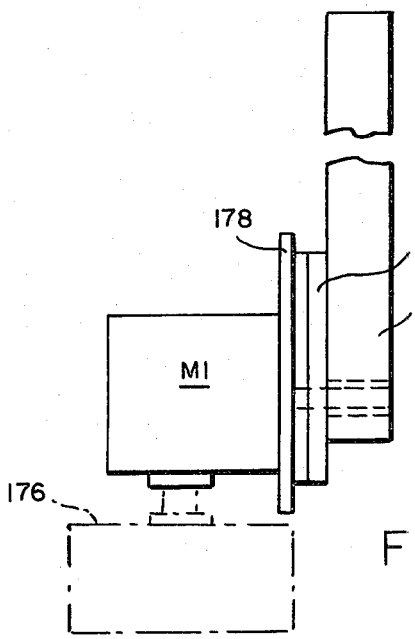
FIG. 6 is an elevation showing a support for a cylindrical cutter and diagrammatically cylindrical cutter.

As mentioned, circular saws 160 are provided for making the end cuts. To make the notch, a cylindrical cutter 176 diagrammatically shown in FIG. 6 is used and this together with its drive motor is bolted to a mounting plate 178 rotatably fastened to a plate 180 fixed to the lower end of a post 182, FIG. 6. The post 182 is vertically adjustable in a sleeve 184 corresponding to the sleeve 154 shown in FIGS. 3 and 5 and is mounted to the carriage 134 suspended for movement on the tracks 130.

Figure 13:
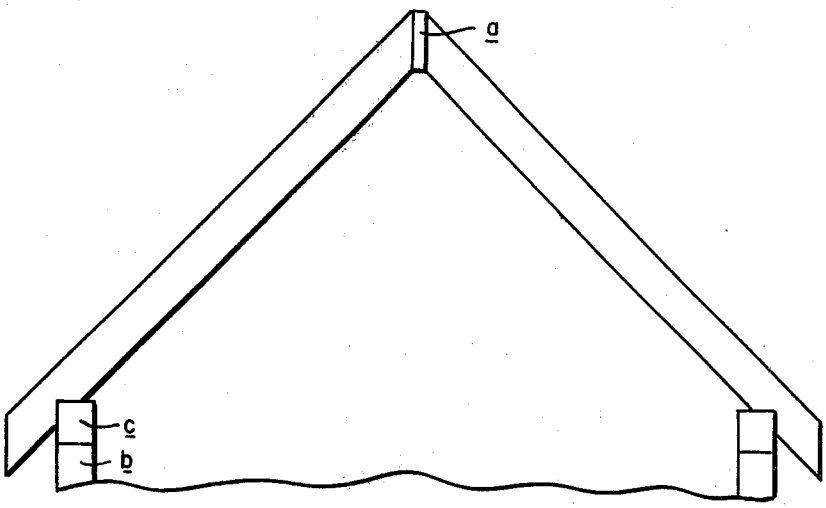
FIG. 13 depicts the structure for which the beams are prepared by the apparatus herein described.
Figure 14:
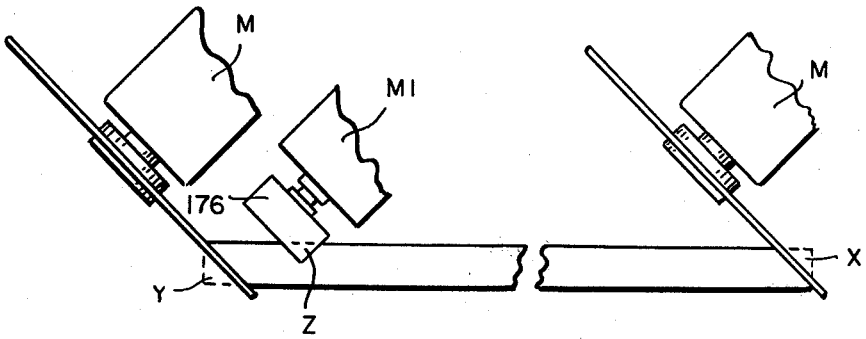
FIG. 14 shows a typical beam, the end cuts and notch to be made and the angular disposition of the cutting instrumentalities for making the cuts.

As has been previously mentioned, this apparatus is designed to make end cuts and a notch on a beam such as used for constructing a roof. However, it is to be understood that additional cuts and notches could be made with this apparatus, depending upon the intended use for the beam and it is considered within the scope of the invention to provide additional trolleys for making cuts or notches at any required longitudinal position on the beam. Specifically, the cuts that are made with the apparatus as described are shown in FIG. 14, the end parts that are removed by the cuts being labeled X and Y and the wedge providing the notch as Z. A beam thus cut is designed for a structure such as illustrated in FIG. 13 where the upper ends of the beams meet at the ridge pole a, the lower ends project beyond the side wall structure b and the notches rest upon the wall plates c at the tops of the side walls.

In operation, a beam of the desired length and size is placed upon the loading conveyor 10 and pushed onto it until in a proper position for receiving the cuts that are to be made as located by the adjustable stop on the conveyor frame. Reciprocation of the transfer means is then initiated to move the jaws across from the discharge station to the loading station to engage and grip the beam resting on the loading station and then to retract the beam in a direction at right angles to its longitudinal axis across from the loading conveyor to the discharge conveyor beneath the operating instrumentalities which, for the making of a beam such as just described, would comprise two disk saws and a cylindrical cutter. As the traversing means moves the log transversely, the saws and cylindrical cutter are started or may be already running, and as the beam passes beneath them, they operate to make the cuts and notch desired. When the transversing means reaches the opposite side, the jaws are opened so that the beam is released and discharged.

The three cuts described are illustrative of three simple cuts desirable when preparing beams in the form of rafters for roof construction. However, it is to be understood that additional cuts may be made, for example, a notch at the upper ends of a rafter for receiving the ridge pole by adding a trolley and cylindrical cutter for making the same. Further, it is within the scope of the invention to perform these operations on natural logs, debarked logs, dressed logs in the form of beams, rafters, studding and the like when it is desirable to precut and prepare lumber for designated purposes.

It should be understood that the present disclosure is for the purpose of illustration only and includes all modifications or improvements which fall within the scope of the appended claims.

We claim:

1. Apparatus for cutting and notching beams to predetermined specification comprising spaced loading and discharge stations for receiving a beam for treatment and for discharging the beam which has been treated, conveyor means at the receiving station for moving a single beam longitudinally onto the receiving station, conveyor means at the discharge station for moving a single treated beam longitudinally of the discharge station, transfer means supported for reciprocal movement between the receiving and discharge stations, said transfer means being structured to, at the receiving station, take hold of a single beam at longitudinally-spaced position lengthwise thereof and, at the discharge station, to release the beam, means operably connected to the transfer means for effecting its reciprocation and for causing the transfer means to on the one hand take hold of a mean at the receiving station and on the other hand to release the treated beam at the discharge station, a plurality of operating instrumentalities, means supporting the operating instrumentalities above the path of travel of the beam from the receiving station to the discharge station in a position to be engaged by the beam as it is moved from one station to the other, said instrumentalities being positioned to produce the required cuts in precisely predetermined positions as controlled by the position of the beam at the receiving station and the transfer of said prepositioned beam from said predetermined position at the receiving station relative to the operating instrumentalities, and means at the receiving station for controlling the longitudinal portion of the beam relative to said instrumentalities.

2. Apparatus according to claim 1 wherein the loading and discharge stations comprise spaced, parallel, longitudinally-extending supporting frames and conveyor means comprising spaced rollers supported on said frames for rotation about axes at right angles to the longitudinal dimensions of the frames.

3. Apparatus according to claim 2 wherein there is means for rotating the rollers on the discharge conveyor.

4. Apparatus according to claim 1 wherein the discharge conveyor is power driven.

5. Apparatus according to claim 1 wherein each jaw comprises a lower stationary jaw member situated at a level to be moved beneath a beam resting on the conveyor at the loading station and an upper jaw arranged to be moved from a position retracted from the lower jaw to a position of clamping engagement with the top of a beam resting on the conveyor at a loading station.

6. Apparatus according to claim 1 wherein the means at the receiving station for controlling the longitudinal position of the beam relative to the instrumentalities comprises a stop on the loading conveyor adjustable longitudinally thereof.

7. Apparatus for cutting and notching beams to a predetermined specification comprising spaced, parallel loading and discharge stations for receiving and discharging beam to be treated, transfer means comprising longitudinally-spaced jaws and means for opening and closing the jaws on the beam at each station to, respectively, seize a beam at the loading station and release it at the discharge station, said transfer means being operable to move the jaws in a direction at right angles to the conveyor means, operating instrumentalities for performing one or more operations on the beam at different places longitudinally thereof, means supporting the instrumentalities intermediate the loading and discharge stations at a level above the path of travel of the beam from the loading station to the discharge station such that the transfer means moves the beam into engagement with all of the operating instrumentalities as it moves the beam from the loading station to the discharge station and means for effecting reciprocation of the transfer means.

8. Apparatus for cutting and notching beams to predetermined specification comprising spaced, parallel loading and discharge stations for receiving and discharging beams to be treated, transfer means comprising carriages and jaws on the carriages movable transversely from one station to the other and back, said jaws being operable to seize a beam at the receiving station and move it therefrom to the discharge station in a direction at right angles to the conveyor means, operating instrumentalities for performing one or more operations on the beam at different places longitudinally thereof, means supporting the instrumentalities intermediate the loading and discharge stations at a level above the path of travel of the beam from the loading station to the discharge station such that the transfer means moves the beams into engagement with all the operating instrumentalities as it moves the beam from the loading station to the discharge station and means for effecting reciprocation of the transfer means.

9. Apparatus according to claim 8 wherein the carriages are adjustable longitudinally relative to each other for beams of different length.

10. Apparatus according to claim 9 wherein there are means for fixing the carriages in a selected position of adjustment.

11. Apparatus according to claim 8 wherein the carriages are supported adjacent the discharge station and there are rack and pinion means for moving the jaws transversely from one station to the other.

12. Apparatus according to claim 8 wherein there are rack bars mounted on the carriages for movement transversely of the conveyors, pinions for effecting reciprocation of the rack bars and means mounting the jaws to the distal ends of the rack bars.

13. Apparatus for cutting and notching beams to predetermined specification comprising spaced, parallel loading and discharge stations for receiving and discharging beams to be treated, transfer means operable to seize a beam at the receiving station and move it therefrom to the discharge station in a direction at right angles to its length, operating instrumentalities for performing one or more operations on the beam at different places longitudinally thereof, means supporting the operating instrumentalities intermediate the loading and discharge stations at a level above the path of travel of the beam from the loading station to the discharge station such that the transfer means moves the beam into engagement with all of the operating instrumentalities as it moves the beam from the loading station to the discharge station, said supporting means comprising trolleys supported for movement lengthwise of the conveyors and means for effecting reciprocation of the transfer means.

14. Apparatus according to claim 13 wherein the cutting instrumentalities are supported on the trolleys for vertical adjustment relative to the horizontal path of movement of the beam.

15. Apparatus for cutting and notching beams to a predetermined specification comprising spaced, parallel loading and discharge stations for receiving and discharging beams to be treated, transfer means operable to seize the beam at the reeiving station and move it therefrom to the discharge station in a direction at right angles to its length, operating instrumentalities for performing one or more operations on the beam at different places longitudinally thereof, means for supporting the instrumentalities intermediate the loading and discharge stations at a level above the path of travel of the beams from the loading station to the discharge station such that the transfer means moves the beam into engagement with all of the operating instrumentalities as it moves the beam from the loading station to the discharge station, said supporting means comprising tracks supported above the conveyors in spaced, parallel relation thereto and intermediate the conveyors, trolleys mounted in suspension from the tracks for movement longitudinally of the conveyors and means for fixing the trolleys at predetermined positions to said tracks and means for effecting reciprocation of the transfer means.

16. Apparatus according to claim 15 wherein the cutting instrumentalities comprise circular saws supported by the trolleys for adjustment of their blades to the angles of the cuts to be made.

17. Apparatus according to claim 15 wherein the cutting instrumentalities comprise cylindrical cutters supported from the trolleys for adjustment of their axis of rotation to the angle of the cut to be made.

18. Apparatus for cutting and notching beams to a predetermined specification comprising spaced, parallel loading and discharge stations for receiving and discharging beams to be treated, transfer means operable to seize a beam at the receiving station and move it therefrom to the discharge station in a direction at right angles to its length, operating instrumentalities for performing one or more operations on the beam at different places longitudinally thereof, means supporting the instrumentalities intermediate the loading and discharge stations at a level above the path of travel of the beam from the loading station to the discharge station such that the transfer means moves the beam into engagement with all of the operating instrumentalities as it moves the beam from the loading station to the discharge station, means for effecting reciprocation of the transfer means and stops on the discharge conveyor at the discharge station arranged to prevent the beam from being withdrawn from the conveyor by retraction of the transfer means.

* * * * *